US009649571B1

(12) United States Patent
Howell et al.

(10) Patent No.: US 9,649,571 B1
(45) Date of Patent: May 16, 2017

(54) WATER ROCKET FIN ATTACHMENT SYSTEM

(71) Applicants: William Scott Howell, Lynn Haven, FL (US); Scott Douglas Farner, Panama City, FL (US)

(72) Inventors: William Scott Howell, Lynn Haven, FL (US); Scott Douglas Farner, Panama City, FL (US)

( * ) Notice: Subject to any disclaimer, the term of this patent is extended or adjusted under 35 U.S.C. 154(b) by 0 days.

(21) Appl. No.: 14/938,813

(22) Filed: Nov. 11, 2015

(51) Int. Cl.
*A63H 27/00* (2006.01)

(52) U.S. Cl.
CPC ..... *A63H 27/005* (2013.01)

(58) Field of Classification Search
USPC ..... 446/71, 73, 74, 77, 98, 100, 230, 231; 206/457; 215/379, 382, 386; 434/276
See application file for complete search history.

(56) References Cited

U.S. PATENT DOCUMENTS 3,018,583 A * 1/1962 Novotney ..... A63H 3/005 446/73
5,712,021 A * 1/1998 Hernandez ..... B32B 1/08 156/152
6,176,755 B1 * 1/2001 Bye ..... A63H 17/002 446/465
6,488,556 B2 * 12/2002 Galomb ..... A63H 3/005 215/900
6,568,170 B1 * 5/2003 Rives ..... A63H 27/005 124/57
6,957,526 B1 * 10/2005 Lin ..... F41B 11/89 446/52
7,476,103 B1 * 1/2009 Norman ..... G09B 23/06 434/276
7,601,046 B2 * 10/2009 Chang ..... A63H 27/005 124/26
8,528,761 B2 * 9/2013 Yarro ..... A63H 27/005 215/379
2004/0055920 A1 * 3/2004 Perez ..... B65D 1/0223 206/457
2013/0233871 A1 * 9/2013 Gluck ..... B65D 25/34 220/737

* cited by examiner

*Primary Examiner* — Kurt Fernstrom

(57) ABSTRACT

A plastic sheet that can be formed into a cylinder or truncated cone and attached to a pressure vessel by use of integral self-adhesive tabs. The cylinder or truncated cone is then used as an extension and structure for the attachment of rocket fins.

6 Claims, 5 Drawing Sheets

WATER ROCKET FIN ATTACHMENT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE EFS-WEB

Not Applicable

STATEMENT REGARDING PRIOR DISCLOSURES BY THE INVENTOR OR A JOINT INVENTOR

Not Applicable

BACKGROUND OF INVENTION

In many water rocket systems the body of the rocket requires a plastic carbonated drink bottle that uses the addition of a nose cone and fins to achieve stable rocket flight. Many of the existing methods used to build water rockets are impractical, heavy, unreliable, time consuming, and ineffective. This fin attachment system is unique, practical, light weight, reliable, and effective.

BRIEF SUMMARY OF INVENTION

In one embodiment, a flat plastic sheet, of the appropriate dimensions, is used as an extension attached to a plastic carbonated drink bottle. This extension functions as an attachment point for application of fins on a plastic drink bottle. The flat plastic sheet is formed into a cylinder using high strength double sided adhesive tape on an overlapping seam. The cylinder is attached to a plastic drink bottle using tabs that are an integral part of the plastic sheet. High-strength double-sided adhesive tape strips are strategically applied to the tabs to allow the tabs to be bent away from the bottle for removal of the paper backing from the adhesive and adhered to the bottle. Once applied to the plastic drink bottle the cylinder provides an attachment point for the application of stabilizing fins. The cylinder positions the fins lower on the bottle than can be achieved without the cylinder, increasing their aerodynamic effectivity. The fin attachment system is resilient with minimal aerodynamic drag.

BRIEF DESCRIPTION OF THE DRAWINGS

In the included figures the fin attachment system is shown as a flat sheet, formed into a cylinder, attached to a plastic bottle, and with fins and nose attached in a rocket configuration.

DETAILED DESCRIPTION OF THE INVENTION

Figure 1:
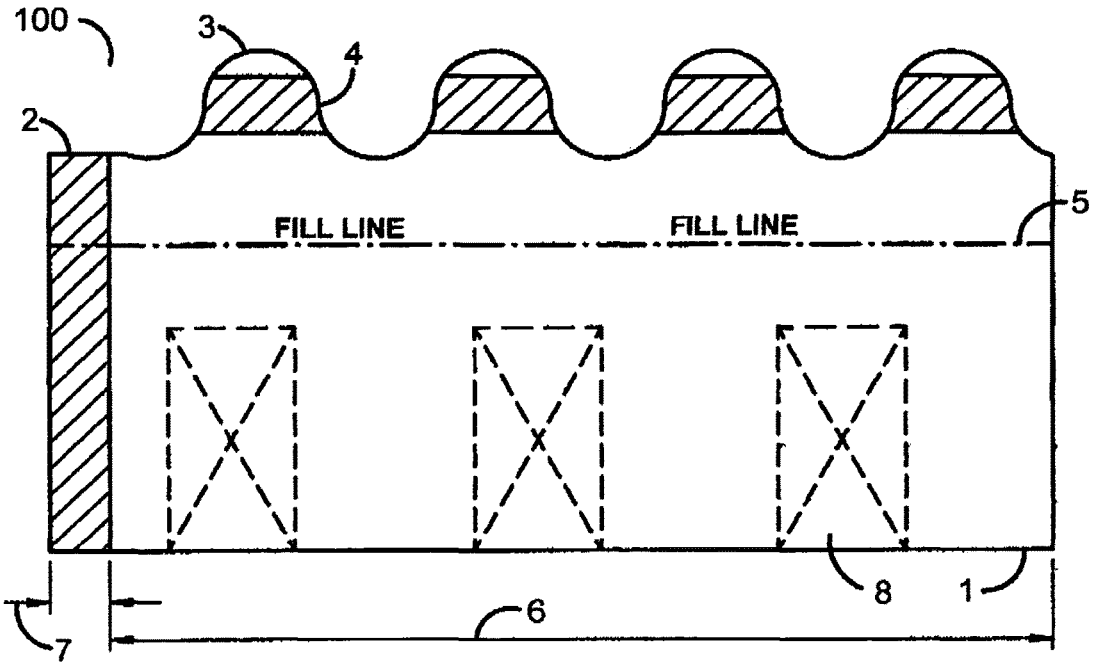
FIG. 1 is a flat sheet view of one embodiment of a fin attachment system.

FIG. 1 is a plan view of the fin attachment system (100). The fin attachment system consists of a transparent plastic sheet (1) including an adhesive strip (2) and multiple tabs (3) with adhesive (4). A water fill line (5) is pre-printed at the location shown. The width (6) is sized to match the circumference of a plastic drink bottle. The overlap (7) containing adhesive strip (2) is used for forming the plastic sheet (1) into a permanent cylinder to fit tightly around a plastic drink bottle. The fin target box (8) is used to properly align stabilizing fins.

Figure 2:
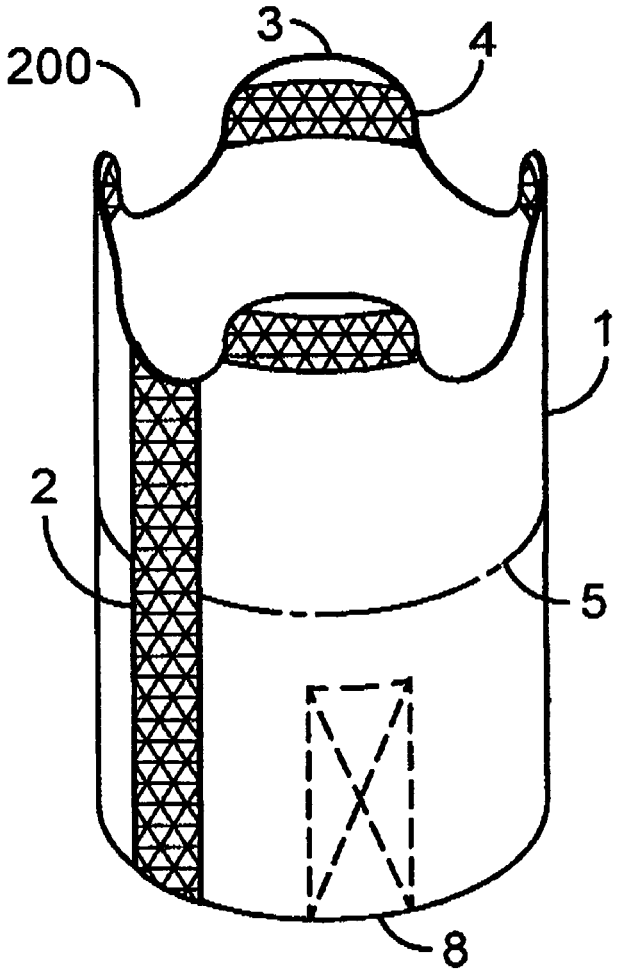
FIG. 2 is an isometric view of one embodiment of a fin attachment system formed into a cylinder.

FIG. 2 is an isometric view of the transparent plastic sheet (1) formed into a cylinder (200) held together by adhesive strip (2). When placed over a plastic drink bottle the cylinder (200) is attached using tabs (3) and adhesive (4). The water fill line (5) represents the recommended water amount for rocket flight. The fin target box (8) provides a target location for proper alignment of fin. Only one fin target box is visible. Any number of evenly spaced boxes can be preprinted on the plastic sheet (1) as required for stable rocket flight.

Figure 3:
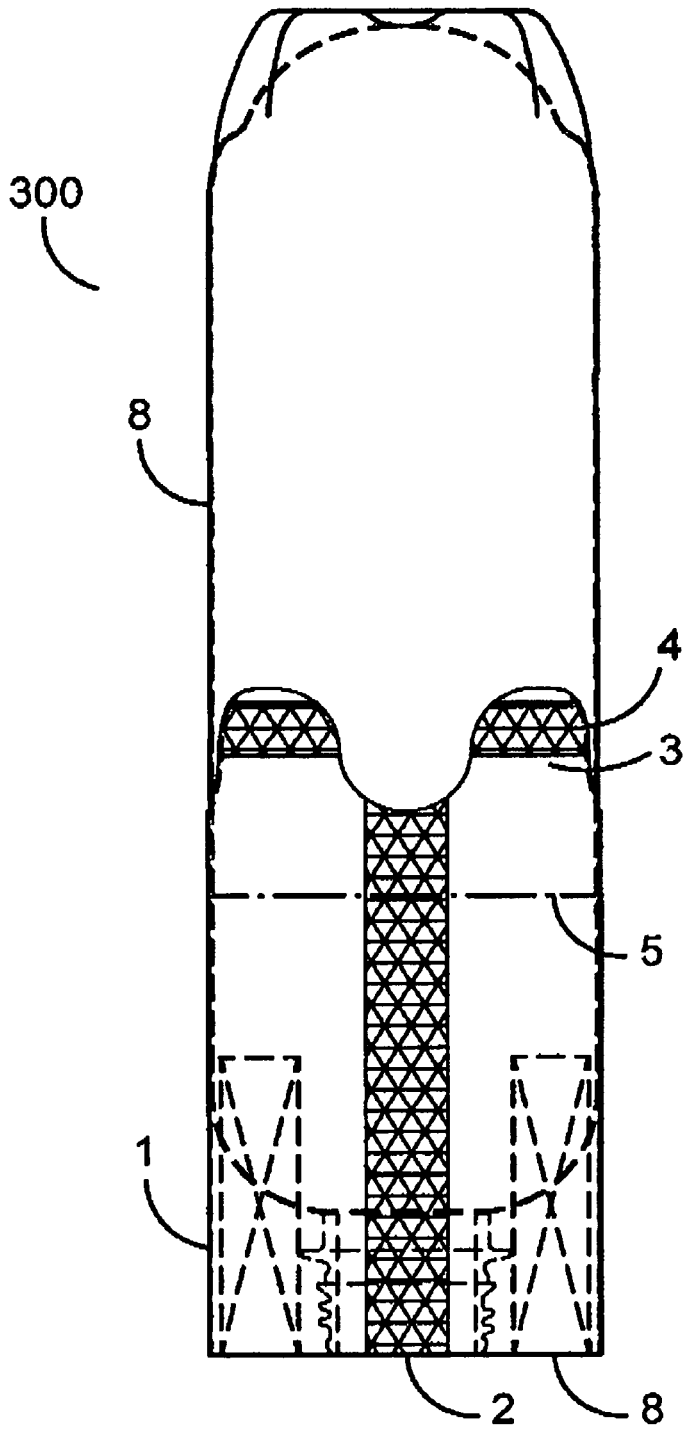
FIG. 3 is a view of one embodiment of a fin attachment system attached to a plastic drink bottle

FIG. 3 is an assembly view of the plastic sheet (1) formed into a cylinder using an adhesive strip (2) and attached to plastic drink bottle (8) using tabs (3) and adhesive (4) to make the foundation for the rocket assembly (300) ready for attachment of a nose cone and fins.

Figure 4:
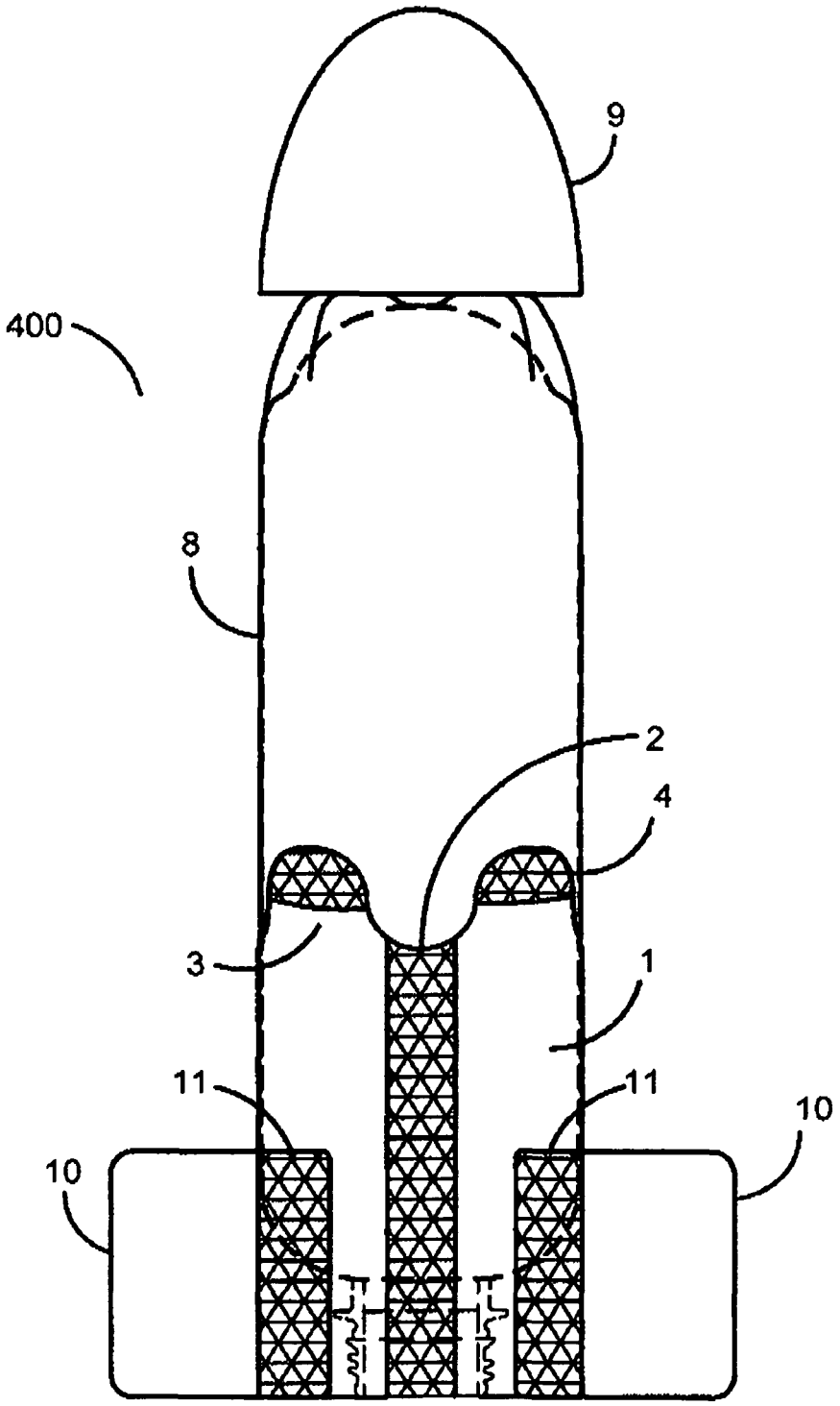
FIG. 4 is a view of one embodiment of the fin attachment system with fins and nose attached to a plastic bottle in a rocket configuration.

FIG. 4 is an assembly view of a complete rocket (400). The rocket is assembled by attaching a plastic sheet (1) formed into a cylinder using an adhesive strip (2) and secured to a drink bottle (8) using tabs (3) with adhesive (4). Nose cone (9) is attached to the bottom of drink bottle (8) and fins (10) are attached to the plastic sheet (1) using adhesive (11).

Figure 5:
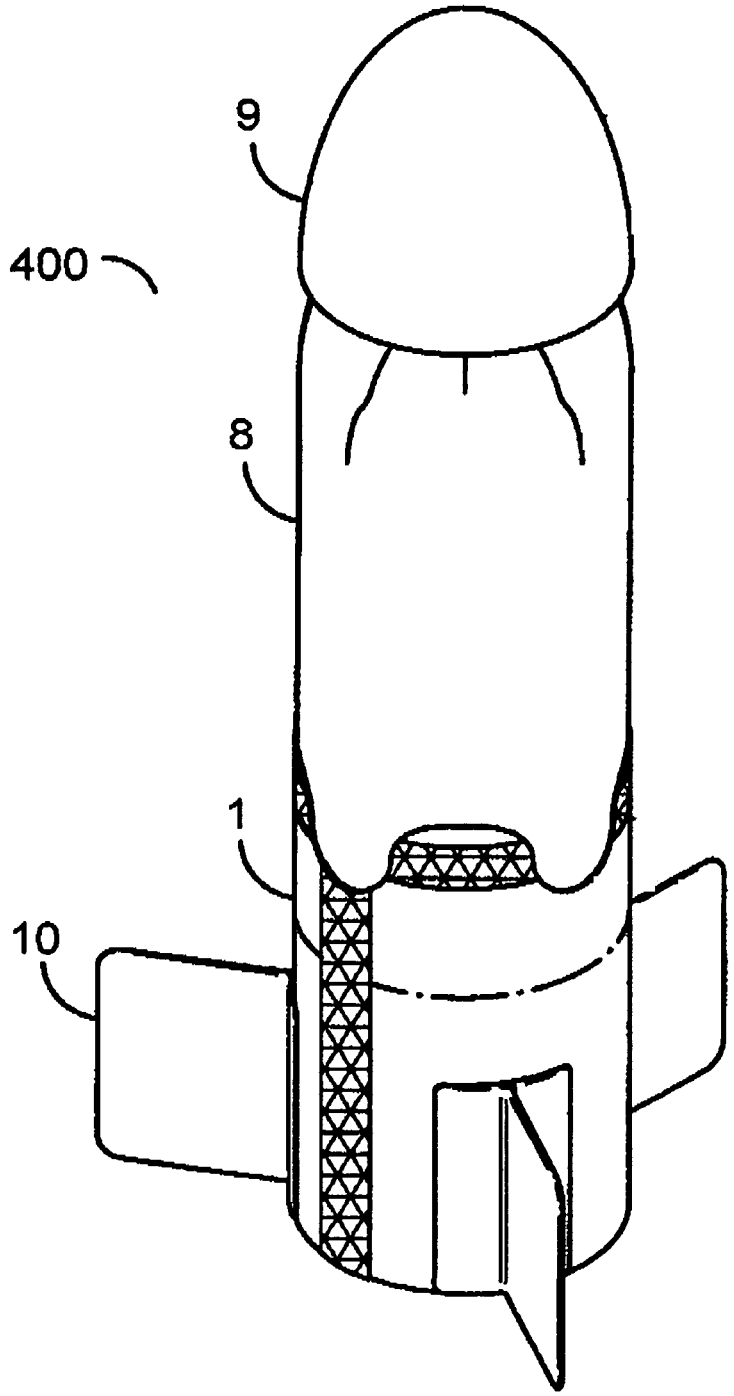
FIG. 5 is an isometric view of one embodiment of a rocket.

FIG. 5 is an isometric view of a complete rocket (400) showing the plastic sheet (1) formed into a cylinder and attached to the plastic drink bottle (8). Fins (10) are attached to the plastic sheet (1) and the nose (9) is attached to the bottom of the bottle (8) which is now the top of the rocket.

The invention claimed is:

1. A plastic water rocket fin attachment system comprising:

a flat sheet of flexible plastic configured to be attached to a plastic drink bottle, said flat sheet comprising a top edge, a first side edge, a second side edge and a bottom edge, wherein said sheet comprises:

a plurality of evenly spaced tabs along said top edge, each tab having adhesive thereon, an adhesive strip along said first side edge, a plurality of evenly spaced fin target boxes printed along said bottom edge, wherein said fin target boxes are configured to guide a user as to where to attach fins to the sheet, and a fill line printed horizontally across said sheet, wherein said fill line is configured to guide a user as to a recommended amount of water to be used to fill the plastic drink bottle; and a plurality of fins configured to be attached to the fin target boxes using adhesive.

2. The plastic water rocket fin attachment system of claim 1, further comprising a plastic drink bottle.

3. The plastic water rocket fin attachment system of claim 1, further comprising a nose cone configured to be attached to the bottom of the plastic drink bottle.

4. The plastic water rocket fin attachment system of claim 1, wherein said tabs are integral to said flat sheet.

5. The plastic water rocket fin attachment system of claim 1, wherein said tabs are generally semicircular in shape.

6. The plastic water rocket fin attachment system of claim 1, wherein said tabs comprise removable paper backing covering said adhesive.

* * * * *